US011612212B2

(12) United States Patent
Langvin et al.

(10) Patent No.: US 11,612,212 B2
(45) Date of Patent: Mar. 28, 2023

(54) SOLE STRUCTURE FOR AN ARTICLE OF FOOTWEAR

(71) Applicant: NIKE, Inc., Beaverton, OR (US)

(72) Inventors: Elizabeth Langvin, Sherwood, OR (US); Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 75 days.

(21) Appl. No.: 16/887,053

(22) Filed: May 29, 2020

(65) Prior Publication Data

US 2020/0375309 A1 Dec. 3, 2020

Related U.S. Application Data

(60) Provisional application No. 62/854,407, filed on May 30, 2019.

(51) Int. Cl.

| | |
|---|---|
| ***A43B 13/20*** | (2006.01) |
| ***A43B 13/12*** | (2006.01) |
| ***A43B 13/04*** | (2006.01) |

(52) U.S. Cl.

CPC ..... *A43B 13/20* (2013.01); *A43B 13/12* (2013.01); *A43B 13/04* (2013.01)

(58) Field of Classification Search

CPC ..... A43B 13/20; A43B 13/12; A43B 13/125; A43B 13/189; A43B 13/186; A43B 13/16; A43B 13/203; A43B 13/18; A43B 13/187; A43B 13/188; A43B 13/122; A43B 13/181

USPC ..... 36/29, 28, 43, 153, 71

See application file for complete search history.

(56) References Cited

U.S. PATENT DOCUMENTS

| | | | | |
|---|---|---|---|---|
| 3,253,355 A * | 5/1966 | Menken | ..... | A43B 13/20 36/29 |
| 4,635,384 A * | 1/1987 | Huh | ..... | A43B 13/20 36/28 |
| 5,141,578 A * | 8/1992 | Yang | ..... | B29B 13/10 264/46.4 |

(Continued)

OTHER PUBLICATIONS

"Gas Laws". Florida State University, https://www.chem.fsu.edu/chemlab/chm1045/gas_laws.html (Year: 2022).*

(Continued)

*Primary Examiner* — Jameson D Collier
*Assistant Examiner* — Matthew R Marchewka
(74) *Attorney, Agent, or Firm* — Honigman LLP; Matthew H. Szalach; Jonathan P. O'Brien

(57) ABSTRACT

A sole structure for an article of footwear includes an outer sole element, an inner sole element, and a membrane. The outer sole element has a first top surface and a recess formed in the first top surface. The recess is defined by an inner peripheral surface extending from the first top surface. The inner sole element is disposed within the recess and has a second top surface and an outer peripheral surface extending from the second top surface. The outer peripheral surface is spaced apart from and opposing the inner peripheral surface of the outer sole element to form a channel between the inner sole element and the outer sole element. The membrane is joined to the first top surface of the outer sole element to sealingly enclose the channel and define a chamber.

16 Claims, 4 Drawing Sheets

(56) References Cited

U.S. PATENT DOCUMENTS 5,741,568 A * 4/1998 Rudy ..... A43B 7/144 428/69
6,131,310 A * 10/2000 Fang ..... A43B 1/0009 36/28
2005/0028401 A1* 2/2005 Johnson ..... A43B 3/0031 36/2.6
2005/0268490 A1 12/2005 Foxen
2007/0051018 A1* 3/2007 Issler ..... A43B 9/02 36/29
2009/0288312 A1* 11/2009 Dua ..... A43B 17/03 36/29
2010/0186264 A1* 7/2010 Cook ..... A43B 13/148 36/30 R
2012/0233880 A1* 9/2012 Chao ..... A43B 13/18 36/29
2012/0255198 A1* 10/2012 Langvin ..... A43B 13/203 36/29
2014/0075779 A1 3/2014 Bruce et al.
2014/0352176 A1* 12/2014 Chang ..... A43B 13/183 36/102
2015/0250259 A1* 9/2015 Attey ..... A43B 13/125 36/103
2017/0042286 A1* 2/2017 Meschter ..... A43B 13/125
2017/0202303 A1* 7/2017 Shepherd ..... A43B 7/141
2018/0255870 A1* 9/2018 Oda ..... A43B 13/188
2019/0029365 A1* 1/2019 Lucca ..... A43B 13/188
2019/0062614 A1* 2/2019 Steinbeck ..... A43B 13/16
2019/0223539 A1* 7/2019 Hoffer ..... B32B 5/16
2020/0121022 A1* 4/2020 Edwards ..... B32B 5/026

OTHER PUBLICATIONS

Taiwan Patent Office, Office Action for Application No. 109118338 dated Jun. 3, 2021.
European Patent Office (ISA), International Search Report and Written Opinion for PCT Application No. PCT/US2020/035077, dated Sep. 16, 2020.

* cited by examiner

SOLE STRUCTURE FOR AN ARTICLE OF FOOTWEAR

CROSS REFERENCE TO RELATED APPLICATION

This non-provisional U.S. patent application claims priority under 35 U.S.C. § 119(e) to U.S. Provisional Patent Application Ser. No. 62/854,407, filed May 30, 2019, the disclosure of which is hereby incorporated by reference in its entirety.

FIELD

The present disclosure relates generally to sole structures for articles of footwear.

BACKGROUND

This section provides background information related to the present disclosure which is not necessarily prior art.

Articles of footwear typically include an upper and a sole structure attached to the upper. The sole structure may have a variety of configurations and provides a user with a degree of comfort during use. Namely, sole structures generally include a midsole that absorbs ground-reaction forces during running and walking movements and an outsole that provides the sole structure with abrasion resistance and traction.

Conventional midsoles typically employ a cushioning material such as foam either with or without a fluid-filled chamber to provide a desired level of cushioning and responsiveness during use. Such fluid-filled chambers are often pressurized and at least partially encapsulated in the foam material of the midsole. Further, the fluid-filled chambers are generally formed separate and apart from the foam material such that the fluid contained within the chamber is contained by cooperating barrier sheets of the fluid-filled chamber. Once inflated, the pressurized, fluid-filled chamber is incorporated into the foam material of the midsole, thereby forming the completed midsole assembly.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
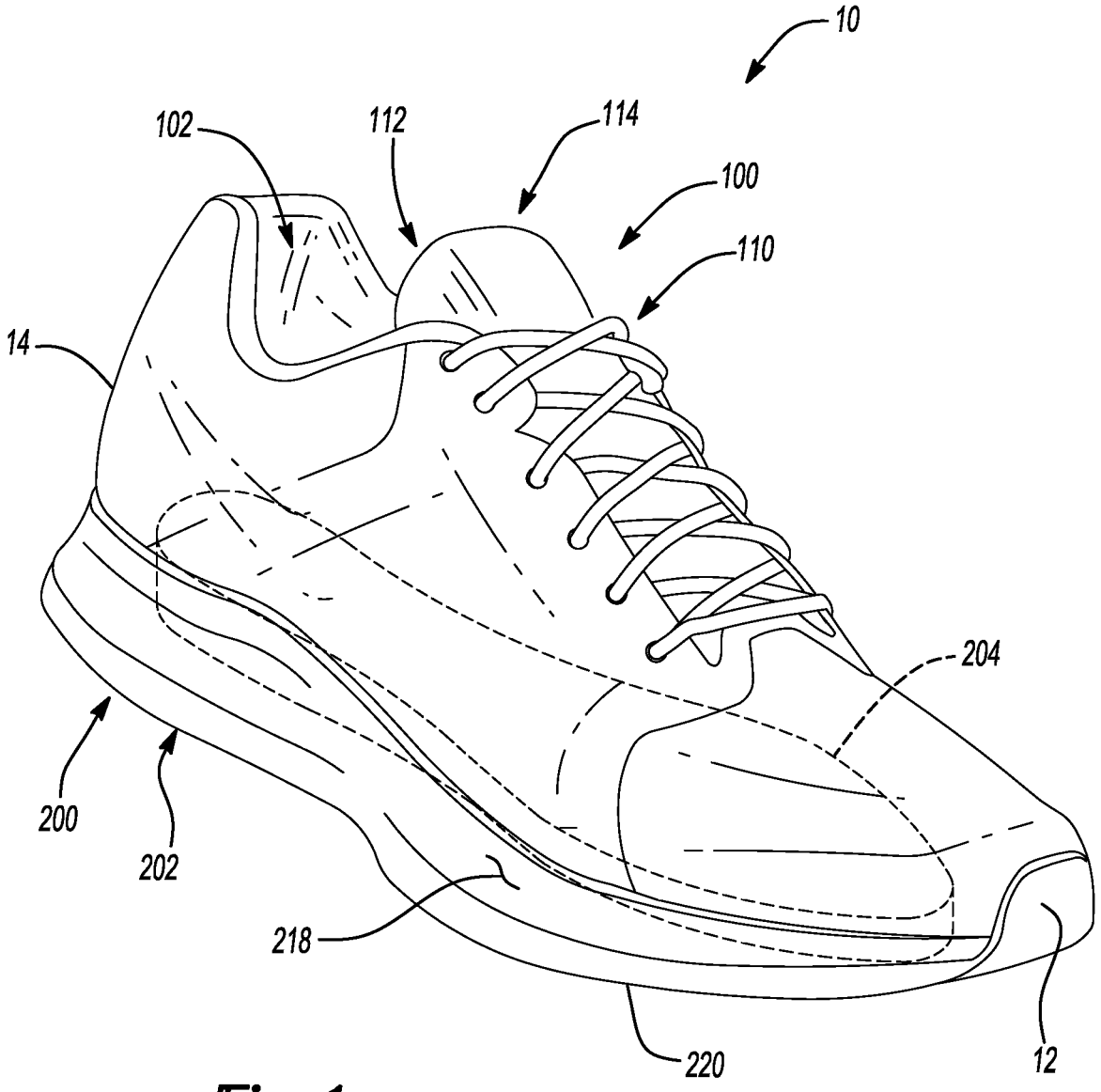
FIG. 1 is a perspective view of an article of footwear.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one aspect, a sole structure for an article of footwear includes an outer sole element, an inner sole element, and a membrane. The outer sole element has a first top surface and a recess formed in the first top surface. The recess is defined by an inner peripheral surface extending from the first top surface. The inner sole element is disposed within the recess and has a second top surface and an outer peripheral surface extending from the second top surface. The outer peripheral surface is spaced apart from and opposes the inner peripheral surface of the outer sole element to form a channel between the inner sole element and the outer sole element.

The membrane is joined to the first top surface of the outer sole element to sealingly enclose the channel and define a chamber.

In another aspect, an article of footwear includes an upper and a sole structure joined to the upper. The sole structure includes an outer sole element, an inner sole element, and a membrane. The outer sole element has a first top surface and a recess formed in the first top surface. The recess is defined by an inner peripheral surface extending from the first top surface. The inner sole element is disposed within the recess and has a second top surface and an outer peripheral surface extending from the second top surface. The outer peripheral surface is spaced apart from and opposes the inner peripheral surface of the outer sole element to form a channel between the inner sole element and the outer sole element. The membrane is joined to the first top surface of the outer sole element to sealingly enclose the channel. The membrane extends between the upper and at least one of the first top surface and the inner sole element.

In some implementations, the chamber is filled with a fluid. The inner peripheral surface may have an upper end at an intersection with the first top surface and a lower end spaced from the upper end. The membrane may be joined to the upper end. The channel may completely surround the inner sole element. The channel may have a constant width.

In some implementations, the outer sole element may be formed of a first material having a first density and the inner sole element may be formed of a second material having a second density different than the first density.

In some implementations, each of the inner peripheral surface of the outer sole element and the outer peripheral surface of the inner sole element may be inwardly offset from and substantially parallel to an outer peripheral surface of the outer sole element.

In some implementations, the first top surface of the outer sole element may be substantially flush with the second top surface of the inner sole element. The membrane may sealingly enclose the inner sole element within the recess. The membrane may be formed of a polymeric material.

Figure 3:
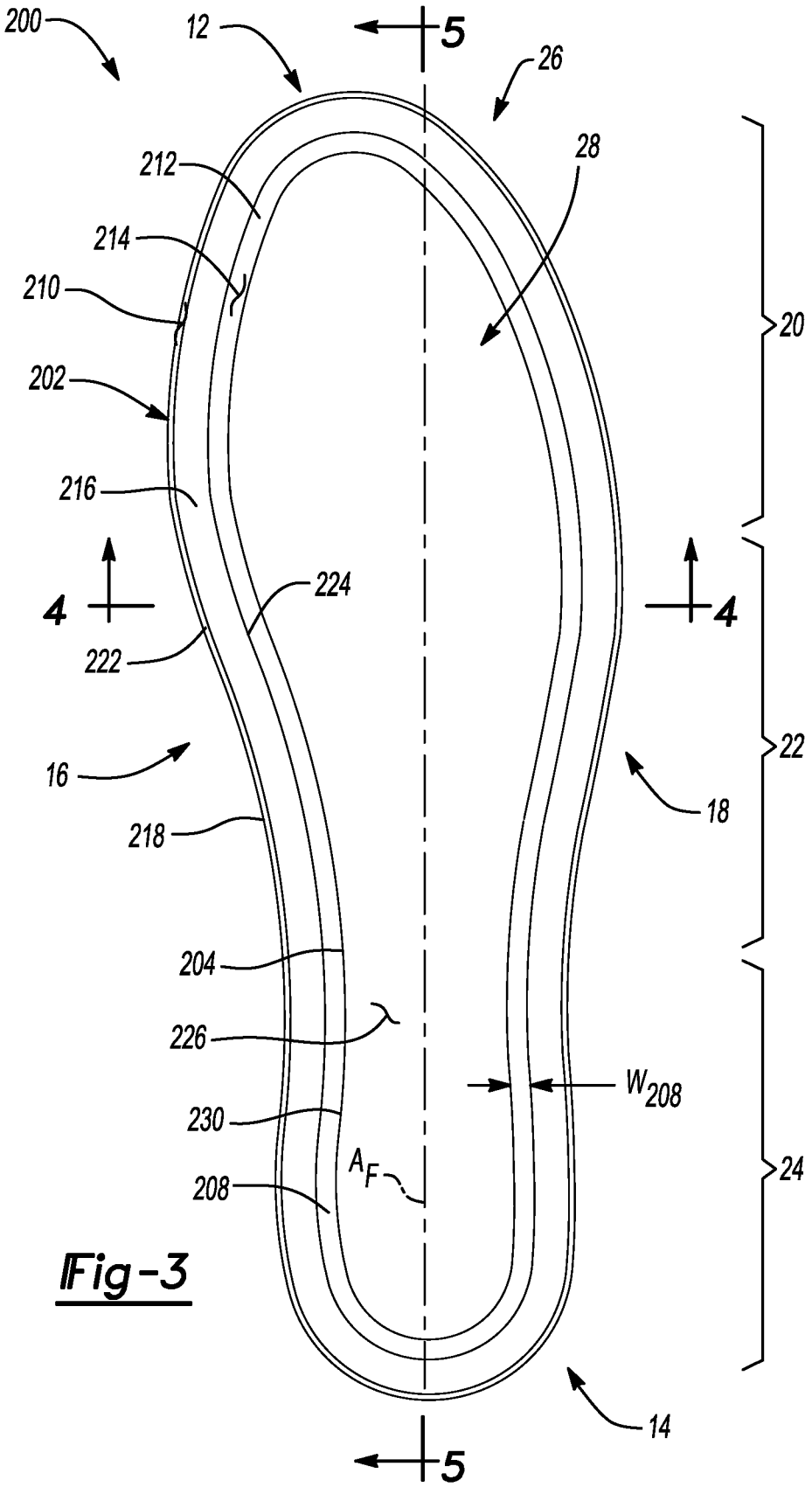
FIG. 3 is a top view of an inner sole element and an outer sole element of the article of footwear of FIGS. 1 and 2.

Referring to FIG. 1, an article of footwear 10 includes an upper 100 and sole structure 200. The footwear 10 may further include an anterior end 12 associated with a forward-most point of the footwear 10, and a posterior end 14 corresponding to a rearward-most point of the footwear 10. As shown in FIG. 3, a longitudinal axis AF of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18. The article of footwear 10 may be divided into one or more regions. The regions may include a forefoot region 20, a mid-foot region 22, and a heel region 24. The mid-foot region 22 may correspond with an arch area of the foot, and the heel region 24 may correspond with rear portions of the foot, including a calcaneus bone.

The upper 100 includes interior surfaces that define an interior void 102 configured to receive and secure a foot for support on the sole structure 200. The upper 100 may be formed from one or more materials that are stitched or adhesively bonded together to form the interior void 102. Suitable materials of the upper may include, but are not limited to, mesh, textiles, foam, leather, and synthetic leather. The materials may be selected and located to impart properties of durability, air-permeability, wear-resistance, flexibility, and comfort.

Figure 2:
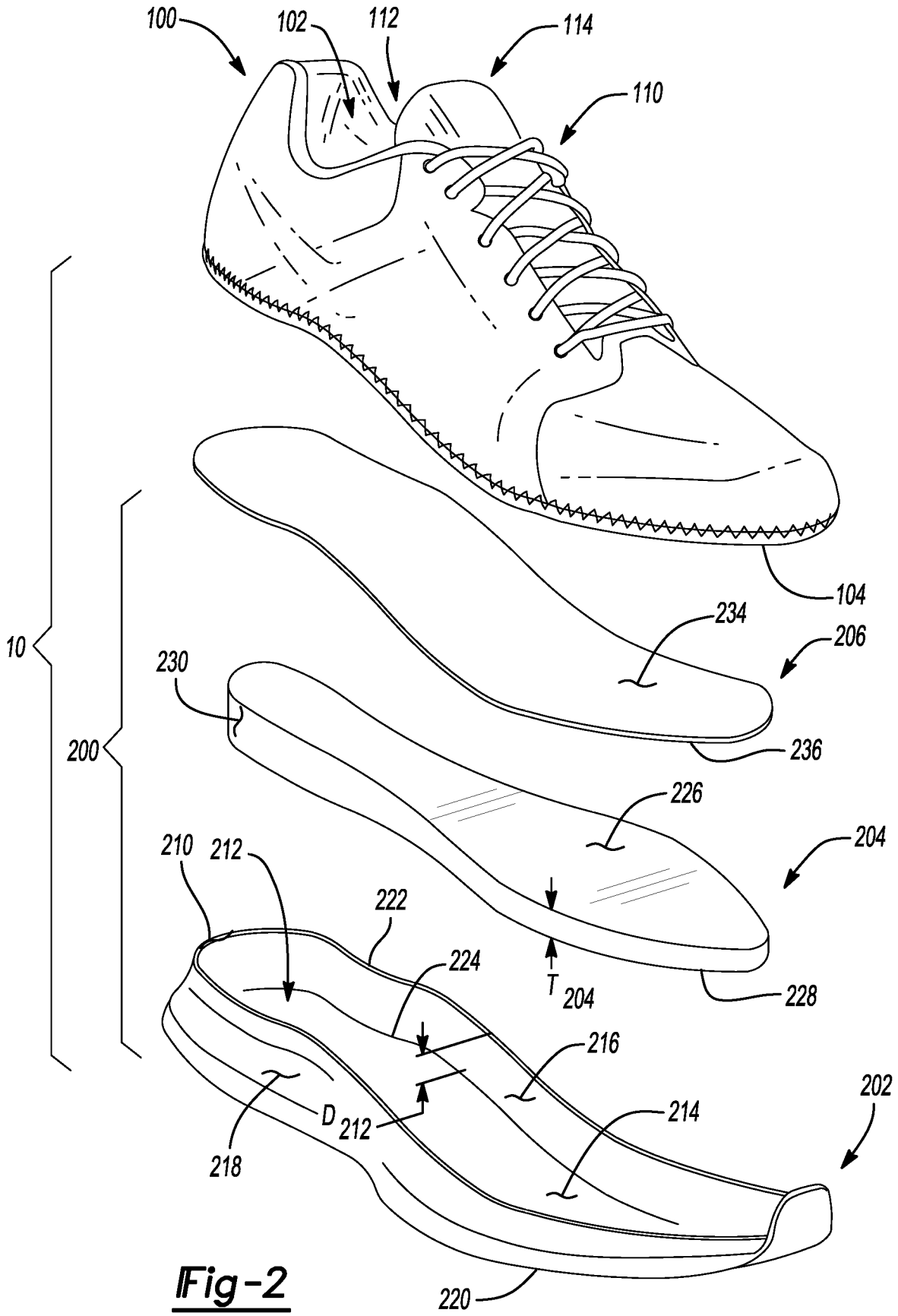
FIG. 2 is an exploded view of the article of footwear of FIG. 1.

With reference to FIG. 2, in some examples, the upper 100 includes a strobel 104 having a bottom surface opposing the sole structure 200 and an opposing top surface defining a footbed 106 of the interior void 102. Stitching or adhesives may secure the strobel to the upper 100. The footbed 106 may be contoured to conform to a profile of the bottom surface (e.g., plantar) of the foot. Optionally, the upper 100 may also incorporate additional layers such as an insole 108 or sockliner that may be disposed upon the strobel 104 and reside within the interior void 102 of the upper 100 to receive a plantar surface of the foot to enhance the comfort of the article of footwear 10. An ankle opening 112 in the heel region 24 may provide access to the interior void 102. For example, the ankle opening 112 may receive a foot to secure the foot within the interior void 102 and to facilitate entry and removal of the foot to and from the interior void 102.

In some examples, one or more fasteners 110 extend along the upper 100 to adjust a fit of the interior void 102 around the foot and to accommodate entry and removal of the foot therefrom. The upper 100 may include apertures, such as eyelets and/or other engagement features such as fabric or mesh loops that receive the fasteners 110. The fasteners 110 may include laces, straps, cords, hook-and-loop, or any other suitable type of fastener. The upper 100 may include a tongue portion 114 that extends between the interior void 102 and the fasteners.

With continued reference to FIG. 2, the sole structure 200 includes an outer sole element 202, an inner sole element 204, and a membrane 206. The outer sole element 202 includes a first top surface 210 and a recess 212 defined by the first top surface 210. The first top surface 210 may face the upper 100 at the strobel 104 and, in one configuration, may be attached to the strobel 104 either directly or indirectly, as will be described in greater detail below. The first top surface 210 may extend along a periphery of the outer sole element 202 and may be generally flat, curved, or any other suitable configuration.

The outer sole element 202 may include a ground-engaging surface 220 spaced from and formed on an opposite side of the outer sole element 202 from the first top surface 210. The ground-engaging surface 220 may generally provide abrasion-resistance and traction with a ground surface during use of the article of footwear 10. The ground-engaging surface 220 may be formed from one or more materials that impart durability and wear-resistance, as well as enhance traction with the ground surface. For example, rubber may form at least a portion of the ground-engaging surface 220.

Figure 4:
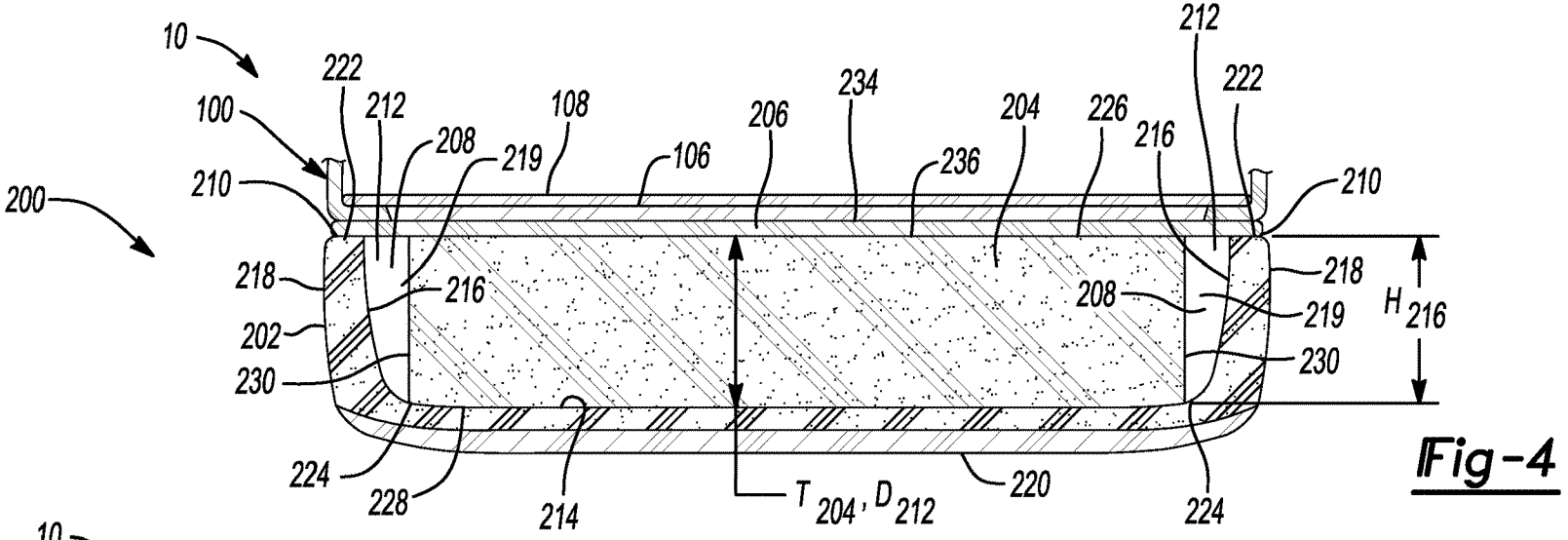
FIG. 4 is a cross-sectional view of a portion of the article of footwear, including the inner sole element and the outer sole element of FIG. 3 and taken along section line 4-4 of FIG. 3.
Figure 5:
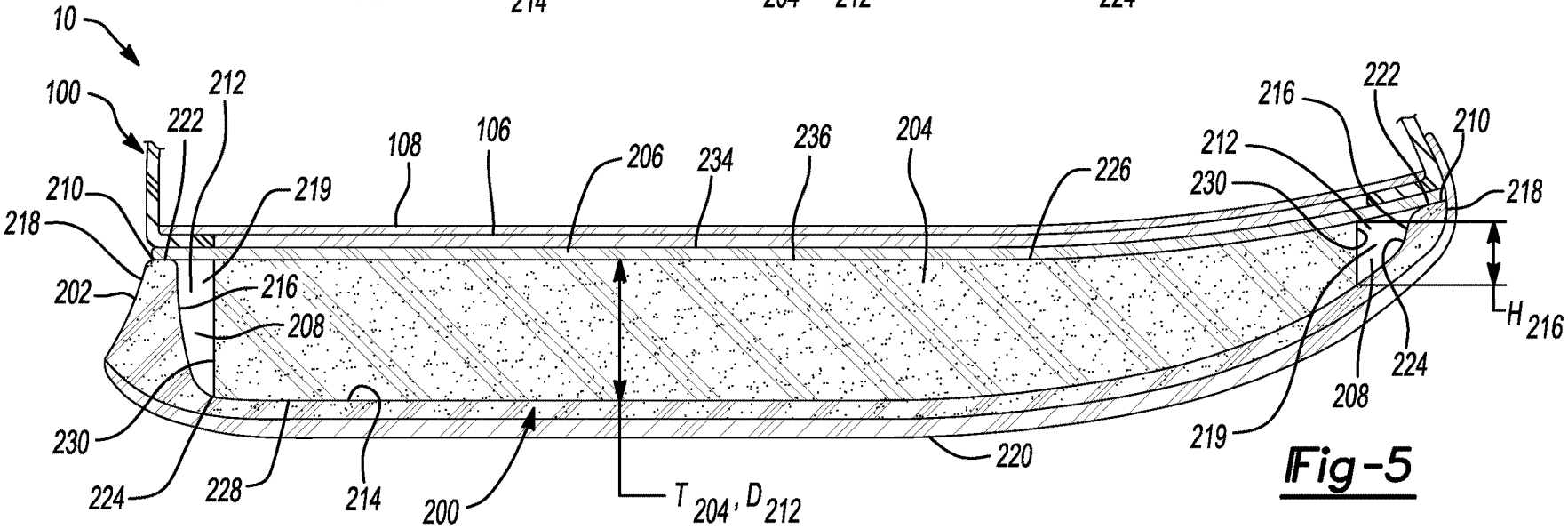
FIG. 5 is another cross-sectional view of a portion of the article of footwear, including the inner sole element and the outer sole element of FIG. 3 and taken along section line 5-5 of FIG. 3.

With reference to FIG. 2, the recess 212 of the outer sole element 202 includes a recessed surface 214 spaced apart from the first top surface 210, and an inner peripheral surface 216 extending from the first top surface 210 to the recessed surface 214. The inner peripheral surface 216 includes an upper end 222 at the first top surface 210 and a lower end 224 spaced from the upper end 222. The lower end 224 of the inner peripheral surface 216 may be disposed at an intersection with the recessed surface 214. For example, the inner peripheral surface 216 may extend from the upper end 222 at the first top surface 210 to the lower end 224 at the recessed surface 214. The inner peripheral surface 216 may have a height $H_{216}$ from the upper end 222 at the first top surface 210 to the lower end 224 at the recessed surface 214 when viewed from a cross-sectional perspective as shown in FIGS. 4 and 5. The height $H_{216}$ may be substantially uniform around the inner peripheral surface 216. Alternatively, the height $H_{216}$ may vary around the inner peripheral surface 216.

The inner peripheral surface 216 may extend from the first top surface 210 at approximately a 90-degree (90°) angle. Alternatively, the inner peripheral surface 216 may extend from the first top surface 210 at any suitable angle. Similarly, the inner peripheral surface 216 may extend from the recessed surface 214 at approximately a 90-degree (90°) angle. Alternatively, the inner peripheral surface 216 may extend from the recessed surface 214 at any suitable angle.

The outer sole element 202 may include an outer peripheral surface 218 spaced from and opposite the inner peripheral surface 216. The outer peripheral surface 218 may extend along the periphery of the outer sole element 202. The outer peripheral surface 218 may completely surround the inner peripheral surface 216. For example, the outer peripheral surface 218 may be arranged in a generally closed-loop configuration, and the entirety of the inner peripheral surface 216 may be disposed within the closed loop defined by the outer peripheral surface 218. The inner peripheral surface 216 may be inwardly offset from and substantially parallel to the outer peripheral surface 218. For example, a distance from the inner peripheral surface 216 to the outer peripheral surface 218 may be substantially uniform around the entirety of the closed loop defined by the outer peripheral surface 218.

As provided above, the recess 212 is defined by the inner peripheral surface 216 and the recessed surface 214. The recess 212 may have a depth $D_{212}$ from the first top surface 210 to the recessed surface 214. For example, the recess 212 may have a first volume $V_{212}$ defined by a surface area of the recessed surface 214 multiplied by the depth $D_{212}$ of the recess 212.

The inner sole element 204 is disposed within the recess 212 and includes a second top surface 226 and an outer peripheral surface 230 extending from the second top surface 226. The inner sole element 204 may include a bottom surface 228 spaced from and on an opposite side of the inner sole element 204 from the second top surface 226. The outer peripheral surface 230 extends from the second top surface 226 to the bottom surface 228. When the inner sole element 204 is disposed within the recess 212, the bottom surface 228 opposes the recessed surface 214 of the outer sole element 202. In some examples, the bottom surface 228 may abut the recessed surface 214. For example, the bottom surface 228 may be joined to the recessed surface 214.

The outer peripheral surface 230 may extend from the second top surface 226 at approximately a 90-degree (90°) angle. Alternatively, the outer peripheral surface 230 may extend from the second top surface 226 at any suitable angle. The outer peripheral surface 230 may likewise extend from the bottom surface 228 at approximately a 90-degree (90°) angle. Alternatively, the outer peripheral surface 230 may extend from the bottom surface 228 at any suitable angle.

The inner sole element 204 may have a thickness $T_{204}$ extending from the second top surface 226 to the bottom surface 228. The thickness $T_{204}$ may be substantially equal to the height $H_{216}$ of the inner peripheral surface 216. As such, the thickness $T_{204}$ may be substantially equal to the depth $D_{212}$ of the recess 212. That is, the first top surface 210 of the outer sole element 202 may be substantially flush with the second top surface 226 of the inner sole element 204. Alternatively, the thickness $T_{204}$ of the inner sole element 204 may be greater than or less than the height $H_{216}$ of the inner peripheral surface 216 and the depth $D_{212}$ of the recess 212. Regardless, the thickness $T_{204}$ may be substantially uniform around the outer peripheral surface 230 or, alternatively, may vary around the outer peripheral surface 230.

The inner sole element 204 may have a second volume $V_{204}$ defined by a surface area of the bottom surface 228 multiplied by the thickness $T_{204}$. The second volume $V_{204}$ of the inner sole element 204 may be less than the first volume $V_{212}$ of the recess 212. For example, the thickness $T_{204}$ may be substantially equal to the depth $D_{212}$ and the second volume $V_{204}$ of the inner sole element 204 may be less than the first volume $V_{212}$ of the recess 212. That is, the surface area of the bottom surface 228 may be less than the surface area of the recessed surface 214. As such, the outer peripheral surface 230 of the inner sole element 204 may be inwardly offset from and parallel to the outer peripheral surface 218. For example, the outer peripheral surface 218 of the outer sole element 202 may be continuously formed, and a distance from the outer peripheral surface 230 of the inner sole element 204 to the outer peripheral surface 218 may be substantially uniform around the entirety of the closed loop defined by the outer peripheral surface 218.

With reference to FIGS. 3-5, the outer peripheral surface 230 of the inner sole element 204 is spaced apart from and opposes the inner peripheral surface 216 of the outer sole element 202 to form a channel 208 between the inner sole element 204 and the outer sole element 202. Particularly, the channel 208 may be defined by the cooperation of the inner sole element 204, the recessed surface 214, and the outer sole element 202. The channel 208 may be filled with a fluid such as, for example, ambient air. Alternatively, the channel 208 may be filled with a pressurized gas, or any other suitable fluid.

The channel 208 may completely surround the inner sole element 204, as shown in FIG. 3. For example, the channel 208 may be arranged in a generally closed-loop configuration, and the entirety of the inner sole element 204 may be surrounded by the closed loop defined by the channel 208. The channel 208 has a width $W_{208}$ along the recessed surface 214 from the inner peripheral surface 216 to the outer peripheral surface 218. The width $W_{208}$ of the channel 208 may be uniform around the entirety of the inner peripheral surface 216 and the outer peripheral surface 218. Alternatively, the width $W_{208}$ of the channel 208 may vary around the inner peripheral surface 216 and the outer peripheral surface 218.

With reference to FIGS. 4 and 5, the membrane 206 is joined to the first top surface 210 of the outer sole element 202 to sealingly enclose the channel 208, thereby defining a chamber 219 extending continuously around a peripheral region of the sole structure 200 between the outer sole element 202 and the inner sole element 204. For example, when the membrane 206 is joined to the first top surface 210, the chamber 219 is defined by the inner peripheral surface 216, the recessed surface 214, and the membrane 206.

In some examples, the membrane 206 may sealingly enclose the inner sole element 204 within the recess 212. For example, when the membrane 206 is joined to the first top surface 210, the inner sole element 204 may be surrounded by and enclosed within the inner peripheral surface 216, the recessed surface 214, and the membrane 206.

The membrane 206 extends between the upper 100 and at least one of the first top surface 210 and the inner sole element 204. As used herein, "at least one of the first top surface 210 and the inner sole element 204" should be understood to mean "only the first top surface 210, only the inner sole element 204, or both the first top surface 210 and the inner sole element 204." For example, the membrane 206 may extend between the upper 100 and the first top surface 210 of the outer sole element 202 (i.e., the upper end 222). As another example, the membrane 206 may extend between the upper 100 and the inner sole element 204 (i.e., the second top surface 226). As yet another example, the membrane 206 may extend between the upper 100 and both the first top surface 210 (i.e., the upper end 222) and the inner sole element 204 (i.e., the second top surface 226). Regardless, a portion of the first top surface 210 may remain exposed to permit the first top surface 210 to be directly attached to the strobel 104. Should the membrane 206 separate the first top surface 210 from the strobel 104, the membrane 206 serves to indirectly attach the first top surface 210 to the strobel 104.

The membrane 206 includes a top surface 234 and a bottom surface 236 spaced from and opposite the top surface 234. The membrane 206 may be attached to at least one of the first top surface 210 and the inner sole element 204. For example, the bottom surface 236 of the membrane 206 may be joined to the first top surface 210 (i.e., at the upper end 222). Additionally or alternatively, the bottom surface 236 of the membrane 206 may be attached to the inner sole element 204 (i.e., at the second top surface 226). Finally, the top surface 234 of the membrane 206 may abut and be attached to the upper 100 either directly or via the strobel 104.

The outer sole element 202 and the inner sole element 204 may be formed of a resilient polymeric material, such as foam or rubber, to impart properties of cushioning, responsiveness, and energy distribution to a foot of a wearer. In the illustrated example, the outer sole element 202 is formed of a first material having a first density and the inner sole element 204 is formed of a second material having a second density. The second density may be different than the first density. For example, the second density may be greater than or less than the first density. Alternatively, the second density may be substantially equal to the first density. For example, the outer sole element 202 may be formed of a material having a greater stiffness in order to provide increased lateral stiffness to the peripheral region 26 of the upper, while the inner sole element 204 may be formed of a material providing greater cushioning and impact distribution.

Example resilient polymeric materials for the outer sole element 202 and the inner sole element 204 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a BANBURY® mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

In some embodiments, the membrane 206 is produced (e.g., thermoformed or blow molded) from a monolayer film (a single layer). In other embodiments, the membrane 206 is produced (e.g., thermoformed or blow molded) from a multilayer film (multiple sublayers). In either aspect, the membrane 206 can have a film thickness ranging from about 0.2 micrometers to about be about one (1) millimeter. In further embodiments, the film thickness for the membrane 206 can range from about 0.5 micrometers to about 500 micrometers. In yet further configurations, the film thickness for the membrane 206 can range from about one (1) micrometer to about 100 micrometers.

The membrane 206 can be transparent, translucent, and/or opaque. As used herein, the term "transparent" for a membrane and/or a fluid-filled chamber means that light passes through the membrane in substantially straight lines and a viewer can see through the membrane. In comparison, for an opaque membrane, light does not pass through the membrane and one cannot see clearly through the membrane at all. A translucent membrane falls between a transparent membrane and an opaque membrane, in that light passes through a translucent layer but some of the light is scattered so that a viewer cannot see clearly through the layer.

The membrane 206 can be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including hexamethylene diisocyanate (HMDI), TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The chamber 219 can be provided in a fluid-filled or in an unfilled state. For example, the chamber 219 can be filled to include any suitable fluid, such as a gas or liquid. In an aspect, the gas can include air, nitrogen ($N_2$), or any other suitable gas. In other aspects, the chamber 219 can alternatively include other media, such as pellets, beads, ground recycled material, and the like (e.g., foamed beads and/or rubber beads) that partially or completely fill the chamber 219. The fluid provided to the chamber 219 can result in the chamber 219 being pressurized. Alternatively, the fluid provided to the chamber 219 can be at atmospheric pressure such that the chamber 219 is not pressurized but, rather, simply contains a volume of fluid at atmospheric pressure.

The chamber 219 desirably has a low gas transmission rate to preserve its retained gas pressure. In some configurations, the chamber 219 has a gas transmission rate for nitrogen gas that is at least about ten (10) times lower than a nitrogen gas transmission rate for a butyl rubber layer of substantially the same dimensions. In an aspect, the chamber 219 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the membrane 206). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In use, the sole structure 200 serves to attenuate ground-reaction forces associated with running or walking to provide a wearer with a degree of cushioning and responsiveness. In fact, due to the construction of the sole structure 200 and the cushioning characteristics of the various components (i.e., the outer sole element 202, the inner sole element 204, the membrane 206, and the chamber 219), the sole structure 200 provides a wearer with different cushioning characteristics at different locations of the sole structure and, further, provides gradient cushioning that may change during use. For example, if the outer sole element 202 and the inner sole element 204 are formed from materials having different cushioning properties, the sole elements 202, 204 may cooperate with the chamber 219 to provide the sole structure with variable force distribution and variable compression across the membrane 206.

In one example, the inner sole element 204 is formed from a foam material having a greater density than the outer sole element 202. As such, when the sole structure 200 is initially loaded, the outer sole element 202 may initially deform which, in turn, causes compression of the chamber 219. Such deformation and compression provides cushioning to the wearer's foot. When the sole structure 200 is further loaded, the inner sole element 204 deforms and compresses, which likewise provides a degree of cushioning as well. However, due to the material of the inner sole element 204, the inner sole element 204 requires more force to deform and compress and, as such, additionally provides responsiveness to the user. While the inner sole element 204 is described as being formed from a relatively dense material, the outer sole element 202 could alternatively or additionally be formed from a relatively dense material, having the same or different (greater) density than the inner sole element 204.

As described, the materials of the inner sole element 202 and the outer sole element 204 may be adjusted to provide a desired cushioning characteristic to the sole structure 200.

The following Clauses provide an exemplary configuration for a sole structure for an article of footwear described above.

Clause 1: A sole structure for an article of footwear, the sole structure comprising an outer sole element having a first top surface and a recess formed in the first top surface, the recess defined by an inner peripheral surface extending from the first top surface, an inner sole element disposed within the recess and having a second top surface and an outer peripheral surface extending from the second top surface, the outer peripheral surface spaced apart from and opposing the inner peripheral surface of the outer sole element to form a channel between the inner sole element and the outer sole element, and a membrane joined to the first top surface of the outer sole element to sealingly enclose the channel and define a chamber.

Clause 2: The sole structure of Clause 1, wherein the chamber is filled with a fluid.

Clause 3: The sole structure of Clause 1, wherein the inner peripheral surface has an upper end at an intersection with the first top surface and a lower end spaced from the upper end, the membrane being joined to the upper end.

Clause 4: The sole structure of Clause 1, wherein the channel completely surrounds the inner sole element.

Clause 5: The sole structure of Clause 4, wherein the channel has a constant width.

Clause 6: The sole structure of Clause 1, wherein the outer sole element is formed of a first material having a first density and the inner sole element is formed of a second material having a second density different than the first density.

Clause 7: The sole structure of Clause 1, wherein each of the inner peripheral surface of the outer sole element and the outer peripheral surface of the inner sole element are inwardly offset from and substantially parallel to an outer peripheral surface of the outer sole element.

Clause 8: The sole structure of Clause 1, wherein the first top surface of the outer sole element is substantially flush with the second top surface of the inner sole element.

Clause 9: The sole structure of Clause 1, wherein the membrane sealingly encloses the inner sole element within the recess.

Clause 10: The sole structure of Clause 1, wherein the membrane is formed of a polymeric material.

Clause 11: An article of footwear comprising an upper and a sole structure joined to the upper, the sole structure comprising an outer sole element having a first top surface and a recess formed in the first top surface, the recess defined by an inner peripheral surface extending from the first top surface, an inner sole element disposed within the recess and having a second top surface and an outer peripheral surface extending from the second top surface, the outer peripheral surface spaced apart from and opposing the inner peripheral surface of the outer sole element to form a channel between the inner sole element and the outer sole element, and a membrane joined to the first top surface of the outer sole element to sealingly enclose the channel, the membrane extending between the upper and at least one of the first top surface and the inner sole element.

Clause 12: The article of footwear of Clause 11, wherein the channel is filled with a fluid.

Clause 13: The article of footwear of Clause 11, wherein the inner peripheral surface has an upper end at an intersection with the first top surface and a lower end spaced from the upper end, the membrane being joined to the upper end.

Clause 14: The article of footwear of Clause 11, wherein the channel completely surrounds the inner sole element.

Clause 15: The article of footwear of Clause 14, wherein the channel has a constant width.

Clause 16: The article of footwear of Clause 11, wherein the outer sole element is formed of a first material having a first density and the inner sole element is formed of a second material having a second density different than the first density.

Clause 17: The article of footwear of Clause 11, wherein each of the inner peripheral surface of the outer sole element and the outer peripheral surface of the inner sole element are inwardly offset from and substantially parallel to an outer peripheral surface of the outer sole element.

Clause 18: The article of footwear of Clause 11, wherein the first top surface of the outer sole element is substantially flush with the second top surface of the inner sole element.

Clause 19: The article of footwear of Clause 11, wherein the membrane sealingly encloses the inner sole element within the recess.

Clause 20: The article of footwear of Clause 11, wherein the membrane is formed of a polymeric material.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

an outer sole element having a first top surface and a recess formed in the first top surface, the recess defined by an inner peripheral surface extending from the first top surface to a recessed surface and an outer peripheral surface extending continuously and defining an outermost portion of the sole structure;

an inner sole element disposed within the recess and having a second top surface and an outer peripheral surface extending from the second top surface to a bottom surface of the inner sole element, the outer peripheral surface spaced apart from and opposing the inner peripheral surface of the outer sole element to form a channel between the inner sole element and the outer sole element, each of the inner peripheral surface of the outer sole element and the outer peripheral surface of the inner sole element are inwardly offset from and parallel to the outer peripheral surface of the outer sole element from a perspective normal to the first top surface; and a membrane joined to the first top surface of the outer sole element to enclose the channel and define a sealed chamber filled with a defined volume of fluid.

2. The sole structure of claim 1, wherein the inner peripheral surface has an upper end at an intersection with the first top surface and a lower end spaced from the upper end, the membrane being joined to the upper end.

3. The sole structure of claim 1, wherein the channel completely surrounds the inner sole element.

4. The sole structure of claim 3, wherein the channel has a constant width.

5. The sole structure of claim 1, wherein the outer sole element is formed of a first material having a first density and the inner sole element is formed of a second material having a second density different than the first density.

6. The sole structure of claim 1, wherein the first top surface of the outer sole element is flush with the second top surface of the inner sole element.

7. The sole structure of claim 1, wherein the membrane sealingly encloses the inner sole element within the recess.

8. The sole structure of claim 1, wherein the membrane is formed of a polymeric material.

9. An article of footwear comprising:

an upper; and a sole structure joined to the upper, the sole structure comprising:

an outer sole element having a first top surface and a recess formed in the first top surface, the recess defined by an inner peripheral surface extending from the first top surface to a recessed surface and an outer peripheral surface extending continuously and defining an outermost portion of the sole structure, an inner sole element disposed within the recess and having a second top surface and an outer peripheral surface extending from the second top surface to a bottom surface of the inner sole element, the outer peripheral surface spaced apart from and opposing the inner peripheral surface of the outer sole element to form a channel between the inner sole element and the outer sole element, each of the inner peripheral surface of the outer sole element and the outer peripheral surface of the inner sole element are inwardly offset from and parallel to the outer peripheral surface of the outer sole element from a perspective normal to the first top surface, and a membrane joined to the first top surface of the outer sole element to enclose the channel and define a sealed chamber filled with a defined volume of fluid, the membrane extending between the upper and at least one of the first top surface and the inner sole element.

10. The article of footwear of claim 9, wherein the inner peripheral surface has an upper end at an intersection with the first top surface and a lower end spaced from the upper end, the membrane being joined to the upper end.

11. The article of footwear of claim 9, wherein the channel completely surrounds the inner sole element.

12. The article of footwear of claim 11, wherein the channel has a constant width.

13. The article of footwear of claim 9, wherein the outer sole element is formed of a first material having a first density and the inner sole element is formed of a second material having a second density different than the first density.

14. The article of footwear of claim 9, wherein the first top surface of the outer sole element is flush with the second top surface of the inner sole element.

15. The article of footwear of claim 9, wherein the membrane sealingly encloses the inner sole element within the recess.

16. The article of footwear of claim 9, wherein the membrane is formed of a polymeric material.

* * * * *